US005677099A

United States Patent [19]

Osawa et al.

[11] Patent Number: 5,677,099

[45] Date of Patent: Oct. 14, 1997

[54] METHOD OF DEVELOPING ELECTROSTATIC LATENT IMAGE USING OSCILLATING BIAS VOLTAGE

[75] Inventors: Keishi Osawa, Yokohama; Nobuyuki Ito, Oume; Hiroaki Tsuchiya, Yokohama, all of Japan

[73] Assignee: Canon Kabushiki Kaisha, Tokyo, Japan

[21] Appl. No.: 636,495

[22] Filed: Apr. 23, 1996

Related U.S. Application Data

[63] Continuation of Ser. No. 247,419, May 23, 1994, abandoned, which is a continuation of Ser. No. 688,112, Apr. 19, 1991, abandoned.

[30] Foreign Application Priority Data

Apr. 19, 1990 [JP] Japan ..... 2-103368
Jun. 26, 1990 [JP] Japan ..... 2-169224

[51] Int. Cl.[6] ..... G03G 13/06

[52] U.S. Cl. ..... 430/102; 430/45; 430/126

[58] Field of Search ..... 430/102, 45, 126

[56] References Cited

U.S. PATENT DOCUMENTS 4,292,387 9/1981 Kanbe et al. ..... 430/102
4,395,476 7/1983 Kanbe et la. ..... 430/102
4,450,220 5/1984 Haneda et al. ..... 430/102
4,666,804 5/1987 Haneda et al. ..... 430/102
4,797,335 1/1989 Hiratsuka et al. ..... 430/102
5,066,979 11/1991 Goto et al. ..... 355/208

*Primary Examiner*—Mark Chapman
*Attorney, Agent, or Firm*—Fitzpatrick, Cella, Harper & Scinto

[57] ABSTRACT

In a method of developing an electrostatic latent image formed on an image bearing member, wherein a developer carrying member carrying a layer of a developer is faced to the image bearing member and is supplied with an oscillating bias voltage to form an oscillating electric field in a developing zone, the improvement residing in: that a maximum Vu1max of a potential difference Vu1 between an image portion potential of the latent image and a potential of the developer carrying member in a transfer phase of the oscillating electric field, is larger than a maximum Vr1max of a potential difference Vr1 therebetween in a back-transfer phase thereof; that a maximum Vu2max of a potential difference Vu2 between a non-image portion potential of the latent image and a potential of the developer carrying member in the transfer phase of the oscillating electric field, is not less than a maximum Vr2max of a potential Vr2 therebetween in the back-transfer phase thereof; that integration Iu2, with time, of the potential difference Vu2 is not more than integration Ir2, with time, of the potential difference Vr2.

35 Claims, 11 Drawing Sheets

METHOD OF DEVELOPING ELECTROSTATIC LATENT IMAGE USING OSCILLATING BIAS VOLTAGE

This application is a continuation of application Ser. No. 08/247,419 filed May 23, 1994, which is a continuation of application Ser. No. 07/688,112 filed Apr. 19, 1991, both now abandoned.

FIELD OF THE INVENTION AND RELATED ART

The present invention relates to a method of developing an electrostatic latent image using vibrating or oscillating bias voltage.

U.S. Pat. Nos. 4,292,387 and 4,395,476 disclose a method of developing an electrostatic latent image using an oscillating bias voltage applied to a developer carrying member. In this method, the toner particles are repeatedly deposited onto and removed from an image bearing member by the oscillating electric field formed in a developing zone; and with the attenuation of the oscillating electric field caused by, for example, increase of the space between the image bearing member and the developer carrying member, the toner particles are deposited and remain on the required area of the electrostatic latent image so that the latent image is finally visualized, that is, is developed.

In the above developing method, one period of the oscillating bias voltage has a first phase for transferring the toner particles from the developer carrying member to the image bearing member and a second phase for transferring the toner particles back from the image bearing member to the developer carrying member. In order to prevent the production of a foggy background of the image, the potential difference between the non-image portion of the latent image and the peak level of the voltage in the first phase is made smaller than the potential difference between the non-image portion of the latent image and the peak level of the bias voltage in the second phase. Thus, the toner transferring electric field strength is relatively weak, whereas the toner back-transfer electric field is relatively strong. Therefore, this method is good in the prevention of the production of a foggy background. However, correspondingly, the reproducibility of a thin line and the low potential portion of the electrostatic latent image is slightly unsatisfactory. Therefore, improvement in this respect has been desired.

On the other hand, from the standpoint of the improvement in the image quality, consideration is made as to the use of a small particle size toner having a weight average particle size of 4–9 microns. The small particle size toner has ½–⅓ particle size of the conventionally and widely used toner. Therefore, the surface area per unit weight is 4–9 times as large as the conventional toner. This results in a large amount of triboelectric charge per unit weight. As a result, the electrostatic attraction force to the developer carrying member is large, so that the toner becomes difficult to release from the developer carrying member. This results in a deterioration in the reproducibility of high density images.

Even in the case of a toner having a larger particle size than the small particle size toner, the toner contains a substantial amount of fine toner particles having diameters smaller than the average particle size. Similarly to the small particle size toner, such fine toner has a larger amount of triboelectric charge per unit weight, and this is particularly remarkable under a low humidity ambience or when the developing operation is carried out continuously, even to the extent of overcharging. The fine toner is also difficult to release from the developer carrying member with the result of a tendency of formation of fine particle thin layer on the surface of the developer carrying member. The thin layer obstructs the contact between the developer carrying member and the toner supplied thereto, thus preventing the triboelectric charging of the toner. For these reasons, even if a relatively large particle size toner is used, density of the developed image tends to decrease under the low humidity ambience or when the developing operation is carried out continuously.

In order to solve the problem of the low density of the image, the DC component of the oscillating bias voltage may be changed, or the peak-to-peak voltage (Vpp) may be increased. However, this results in an increase in fog in the background area. For the prevention of the fog, an increase of the frequency of the oscillating bias voltage is effective, but if this is done, the reproducibility of thin lines is deteriorates.

SUMMARY OF THE INVENTION

Accordingly, it is a principal object of the present invention to provide a developing method using an oscillating bias voltage, wherein the reproducibility of thin lines is improved.

It is another object of the present invention to provide a developing method using an oscillating bias voltage wherein the reproducibility of the low potential area of an electrostatic latent image is improved.

It is a further object of the present invention to provide a developing method using an oscillating bias voltage, wherein the tone reproducibility is improved.

It is a further object of the present invention to provide a developing method wherein a high density of the image can be provided even if a small average particle size toner is used.

It is a yet further object of the present invention to provide a developing method wherein good images can be provided even if fine particle toner particles are over-charged.

It is a yet further object of the present invention to provide a developing device or an image forming apparatus using the developing device which embodies any one of the above methods.

According to an aspect of the present invention, the oscillating bias voltage forms the following oscillating electric field.

The maximum Vu1max of the potential difference Vu1 between the image portion potential of the electrostatic latent image and the developer carrying member in a transfer phase is larger than the maximum Vr1max of the potential difference Vr1 therebetween in a back-transfer phase, and an integration Iu1 of the potential difference Vu1 with time is larger than an integration Ir1 of the potential difference Vr1 with time.

On the other hand, the maximum Vu2max of the potential difference Vu2 between the non-image portion of the electrostatic latent image and the developer carrying member in a transfer phase not less than the maximum Vr2max of the potential difference Vr2 therebetween, and an integration Iu2 of the potential difference Vu2 therebetween is not more than an integration Ir2 of the potential difference Vr2 therebetween.

According to another aspect of the present invention, the oscillating bias voltage has first and second peak voltage levels between which the potential of the image portion of the electrostatic latent image and the potential of the non-image portion thereof are present. The difference between the first peak voltage proximate the potential of the non-image portion of the electrostatic latent image and the potential of the non-image portion of the electrostatic latent image is not less than the difference between the second peak voltage proximate the potential of the image portion of the electrostatic latent image and the potential of the non-image portion of the electrostatic latent image. The duty ratio D is less than 0.5. In addition, the vibratory bias voltage satisfies:

$$(1/D) \leqq |Q| \leqq (2.5/D)+25$$

where D is the duty ratio; Q is charge amount per unit weight of the toner (micro-coulomb/g).

By doing so, in the transfer phase of the oscillating electric field, a sufficient quantity of the developer is supplied to the thin line portions and low potential latent image portions as well as the solid black image portions, and in addition, in the back-transfer phase, the removal of the developer from these portions can be prevented. Even so, the fog is sufficiently suppressed in the developed image.

In the regular developing method, wherein the electrostatic latent image is developed with the toner charged to a polarity opposite to that of the electrostatic latent image, the image portion of the electrostatic latent image is the portion having the maximum potential in the absolute value, and the non-image portion of the electrostatic latent image is the minimum potential portion in the absolute value. Therefore, when the image bearing member is an electrophotographic photosensitive member, the portion of the photosensitive member not exposed to the light part of the image light, that is, the so-called dark potential portion, is the image portion, and the portion thereof exposed to the most intense part of the image light, that is, the so-called light potential portion, is the non-image portion. The toner charged to the polarity opposite to the polarity of the latent image should be most deposited on the image portion, and should not be deposited on the non-image portion, or only a small amount should be deposited, if any. A portion having a potential between the potential of the image portion and the potential of the non-image portion is a halftone portion.

The transfer phase in this Specification means the phase in which the potential (bias voltage) of the developer carrying member is so related with the potential of the latent image as to apply to the toner a force in the direction from the developer carrying member to the image bearing member, and the back-transfer phase is the phase in which the potential (bias voltage) of the developer carrying member is so related with the potential of the latent image as to apply to the toner the force from a image bearing member to the developer carrying member.

In this Specification, "large" and "small" values of the voltage or potential difference is determined on the basis of the absolute values.

In this Specification, the integration of a potential with time means an integration, with time, of the absolute value of the potential difference in one period of the oscillating bias voltage.

In this Specification, the duty ratio is defined as follows. The oscillating bias voltage is a function of time t, that is, V(t); the peak level of the oscillating bias voltage at the non-image side is V1; the peak level at the latent image side is V2; Vs is a level between the levels V1 and V2; in the one period (t1+t2) of the oscillating bias voltage, (V(t)–Vs) has the same sign as (V1–Vs) from time 0 to time t1; and (V(t)–Vs) has the same sign as (V2–Vs) from time t1 to time (t1+t2); and $$\int_0^{t_1} |V(t) - Vs|dt = \int_{t_1}^{t_1+t_2} |V(t) - Vs|dt$$

The duty ratio is defined as t1/(t1+t2).

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

In the following description, the case will be taken wherein the latent image is of the positive polarity, and the toner is triboelectrically charged to the negative polarity which is the opposite from the polarity of the latent image, for the sake of simplicity.

Figure 2:
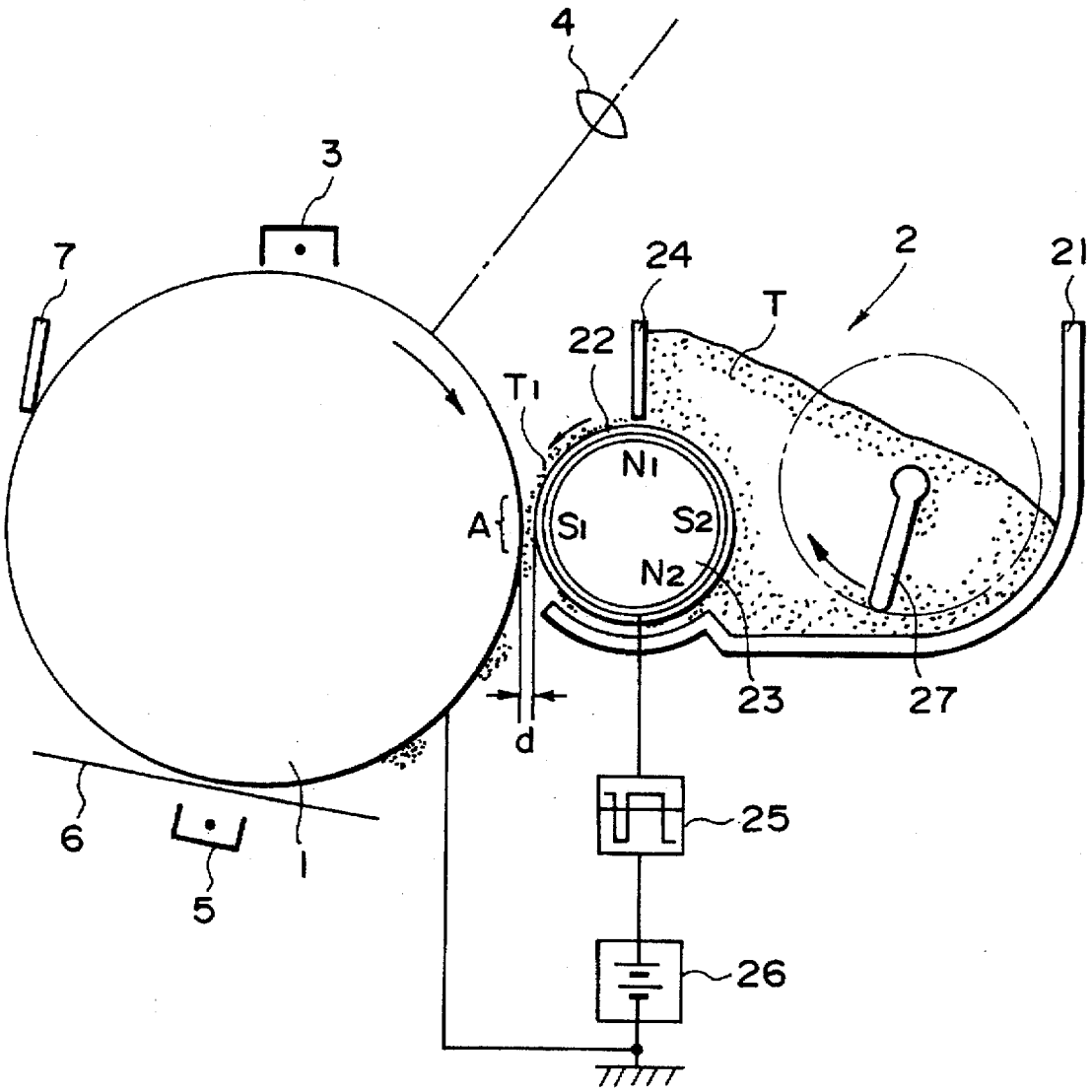
FIG. 2 is a sectional view of a developing apparatus according to an embodiment of the present invention.

Referring to FIG. 2, there is shown a developing apparatus according to an embodiment of the present invention. It comprises a cylindrical electrophotographic photosensitive drum 1 rotatable in a direction indicated by an arrow. In this embodiment, it includes a metal drum electrically grounded and an amorphous silicon layer, for example, as a photosensitive layer.

Around the drum 1, there are disposed a charger 3, an image exposing device 4, a developing device 2, an image transfer device 5 and a cleaning device 7. The toner remaining on the surface of the photosensitive drum 1 after the image transfer is removed by the cleaning device 7. The drum 1 thus cleaned to be substantially free from the toner particles is charged to the positive polarity substantially uniformly by the charger 3 and is exposed to image light by the exposure device 4, so that an electrostatic latent image is formed thereon. The electrostatic latent image has an image portion potential (dark portion potential $V_D$), for example, +500 V, and non-image portion potential (light potential $V_L$), for example, +50 V. The electrostatic latent image is developed by the developing device 2 which will be described in detail hereinafter. The toner image thus provided is transferred onto a transfer material 6 such as paper by the image transfer device 5.

The developing device 2 comprises a container 21 for containing insulative one component magnetic developer T, which will hereinafter be called "toner" or "magnetic toner", which does not contain so-called carrier particles; a cylindrical developer carrying sleeve 22 which is of non-magnetic material such as stainless steel or aluminum and which is supported by the container 21 for rotation in the direction indicated by an arrow at a peripheral speed which is equal to or higher than the peripheral speed of the drum 1; a stationary magnet 23 is stationarily disposed in the sleeve 22; a stirring member 27 for stirring the toner T in the container 21; and a layer thickness regulating blade 24 for regulating a thickness of a toner layer T1 to be conveyed by the sleeve 22 to the developing zone A.

The blade 24 is a magnetic member disposed across the sleeve 22 from a magnetic pole N1 of the magnet 23. It is effective to regulate the toner layer thickness T1 to be smaller than the minimum clearance d (250 microns, for example) between the sleeve 22 and the drum 1 in the developing zone A. The blade 24 may be replaced with a rubber blade, a metal leaf spring blade or another elastic blade press-contacted to the sleeve 22 so as to regulate the thickness of the toner layer T1 to the level described. The toner is released from the sleeve 22 and is deposited on the drum 1 in the developing zone A, which includes the minimum clearance portion between the sleeve 22 and the drum 1 and small areas at the sides thereof. More particularly, by the electric field in the transfer phase, the toner is transferred to the drum 1 and is deposited thereon, whereas by the electric field in the back-transfer phase, the toner is released from the drum 1 and is transferred back to the sleeve 22. Thus, the toner vibrates due to the oscillating electric field. Here, the quantity of the toner transferred to the drum and the quantity of the toner transferred back to the sleeve are significantly different between the image portion and the non-image portion. As the clearance between the drum 1 and the sleeve 22 increases, the electric field therebetween becomes weaker until the developing action terminates, that is, the amount of the toner that corresponds to the potential of the electrostatic latent image remains on the drum 1, so that a toner image is provided. The magnet 23 forms a magnetic field in the developing zone A and is provided with a magnetic pole S1 which contributes to a decrease in the toner scattering or the foggy background production, and magnetic poles N2 and S2 for attracting the toner T in the container 21 to the surface of the sleeve 22.

The toner is triboelectrically charged to a negative polarity, to a degree sufficient for development of the latent image mainly by the rubbing with the sleeve 22.

Voltage sources 25 and 26 constitute the oscillating bias voltage source. The voltage source 25 produces an alternating voltage having a duty ratio less than 0.5, and the voltage source 26 produces a DC voltage having a level between the light portion potential and the dark portion potential. Accordingly, the sleeve 22 is supplied with the oscillating bias voltage which is a DC biased AC voltage. The image portion potential and the non-image portion potential of the latent image is between a first peak level V1 and a second peak level V2 of the oscillating bias voltage. The voltage source 26 may be omitted.

Figure 1:
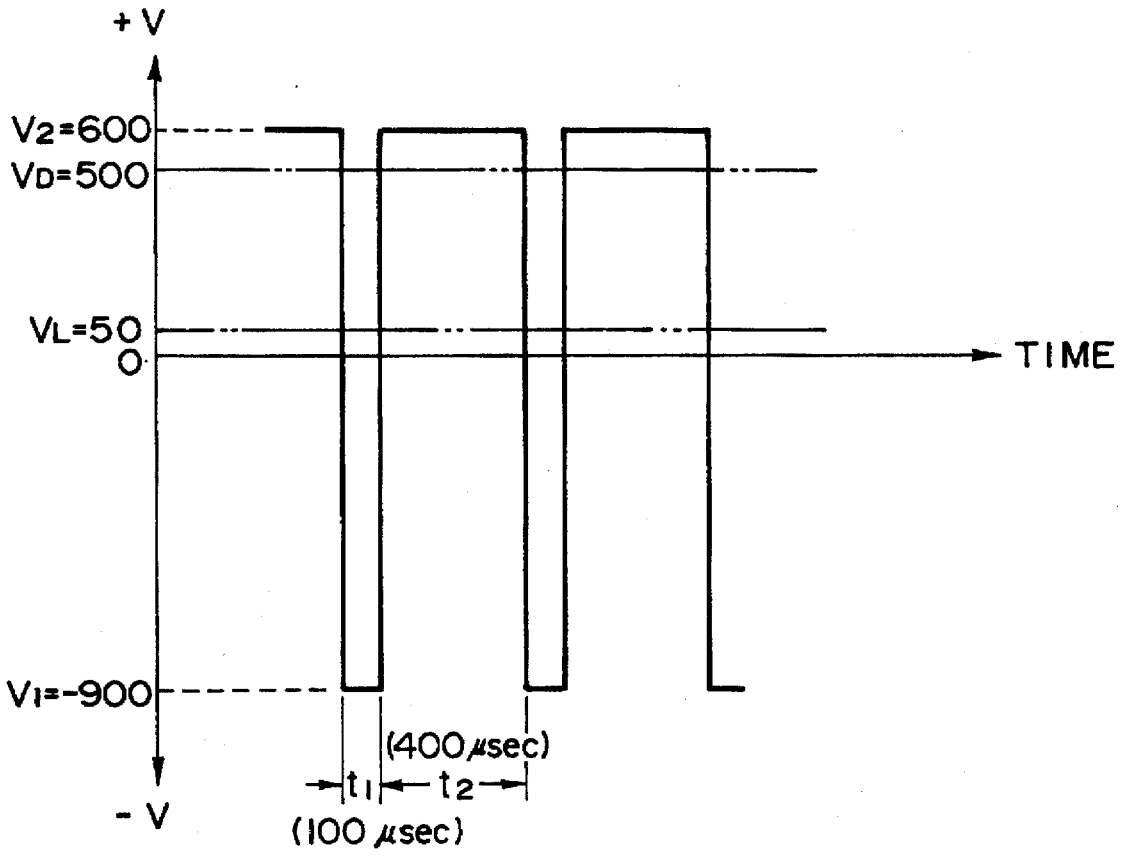
FIG. 1 shows a waveform of an oscillating bias voltage in a method according to an embodiment of the present invention.

FIG. 1 shows a waveform of the oscillating bias voltage applied to the sleeve 22 when good developed images are provided from an electrostatic latent image having the dark portion potential $V_D$ (image-portion potential) of +500 V and the light portion potential $V_L$ (non-image portion potential) of +50 V.

As will be understood, the waveform is a pulse waveform having a duty ratio of 0.2. The peak level V1 in the transfer phase, that is, the peak level closer to the non-image potential or the non-image side peak level was −900 V, and the peak level V2 in the back-transfer phase, that is, the peak level closer to the image portion potential or the image portion side peak level, was +600 V. The voltage source 26 produced a DC voltage component of 300 V. The duration t1 of the transfer phase was 100 micro-sec, and the duration t2 of the back-transfer phase was 400 micro-sec.

As will be understood from FIG. 1, as for the image portion potential $V_D$, $Vu1max=|V_D-V1|=1400$ (V)

$Vr1max=|V_D-V2|=100$ (V)

$Iu1=1400\times t_1=1.4\times10^5$ (V micro-sec)

$Ir1max=100\times t_2=0.4\times10^5$ (V micro-sec)

As for the non-image portion potential $V_L$, $Vu2max=|V_L-V1|=950$ (V)

$Vu2max=|V_L-V2|=550$ (V)

$Iu2=950\times t_1=0.95\times10^5$ (V micro-sec)

$Ir2=550\times t_2=2.2\times10^5$ (V micro-sec)

Accordingly, as for the image portion of the electrostatic latent image, the maximum Vu1max of the potential difference Vu1 between the image portion potential of the electrostatic latent image and the sleeve potential in the transfer phase is larger than the maximum Vr1max of the potential difference Vr1 therebetween in the back-transfer phase; and the integration Iu1 of the potential difference Vu1 with time is larger than the integration Ir1 of the potential difference Vr1 with time. As for the non-image portion of the electrostatic latent image, the maximum Vu2max of the potential difference Vu2 between the non-image portion potential of the electrostatic latent image and the sleeve in the transfer phase is not less than the maximum Vr2max of the potential difference Vr2 therebetween in the back-transfer phase; and the integration Iu2 of the potential difference Vu2 with time is not more than the integration Ir2 of the potential difference Vr2 with time.

In this manner, the image portion receives a sufficient amount of toner, and therefore, the density thereof is sufficient; the halftone portion is visualized satisfactorily, including the low potential portion; the thin lines are reproduced in good order; and a foggy background is not produced.

As contrasted to the conventional system, the maximum potential difference between the non-image portion potential and the sleeve potential in the transfer phase is larger than the maximum potential difference therebetween in the back-transfer phase. Therefore, the toner is urged from the sleeve toward the drum with stronger force. As a result, sufficient toner is supplied to the image portion of the electrostatic latent image, and sufficient toner is also supplied to edge portions of a thin line image, and in addition, a quantity of toner which is larger than required is deposited on the low potential portion.

When the toner is urged to the drum with a strong force, the quantity of the toner deposited and remaining on the non-image portion, that is, the fog in the background is increased. The conventional method for preventing fog is to increase the peak-to-peak voltage of the oscillating voltage to increase the back-transfer tendency from the drum to the sleeve in the back-transfer phase to remove the toner from the non-image portion with strong urging force. If, however, this is done, toner deposited on the image portion, the thin line image portion and the halftone image portion as well as the non-image portion is also removed with the result of poor reproducibility of the thin line image or the low potential portion and the reduction of the density of the image portion.

In consideration of the above factors, the duty ratio of the oscillating bias voltage is made smaller than 0.5 in this embodiment, by which the duration of the back-transfer period is longer than the duration of the transfer period. Thus, the relatively weaker back-transfer force continues for a longer period, in other words, the time integration Iu2 of the potential difference in the transfer phase is not more than the time integration Ir2 of the potential difference in the back-transfer phase, by which the fog toner on the non-image portion can be sufficiently removed, and simultaneously, a sufficient quantity of the toner remains in the image area including the thin lines and the halftone area including the low potential portion. Since the toner deposited on the non-image portion receives a weaker electrostatic attraction force, therefore, it can be sufficiently removed even by the relatively weaker back-transfer force if the force is applied for a relatively long period. On the other hand, the stronger electrostatic attraction force is applied to the toner in the image portion or the halftone portion corresponding to the surface potential thereof, and therefore, the toner is not greatly removed by the relatively weak back-transfer force, even if it is applied for a relatively long period of time.

Figure 3:
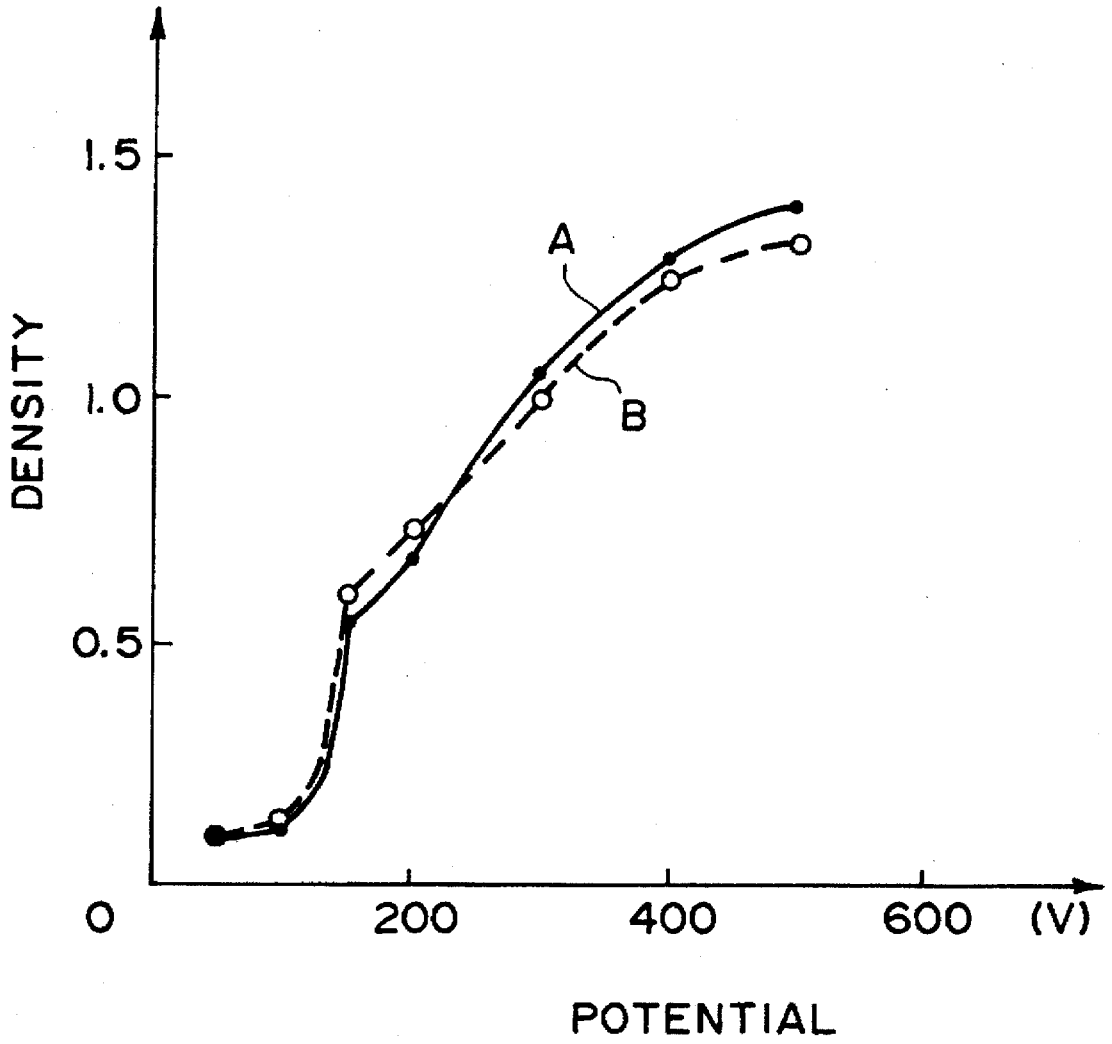
FIG. 3 shows image densities of developed images provided with the use of the bias voltage shown in FIG. 1.

FIG. 3 shows the image density property provided by the oscillating bias voltage of the waveform of FIG. 1 applied to the sleeve.

Figure 4:
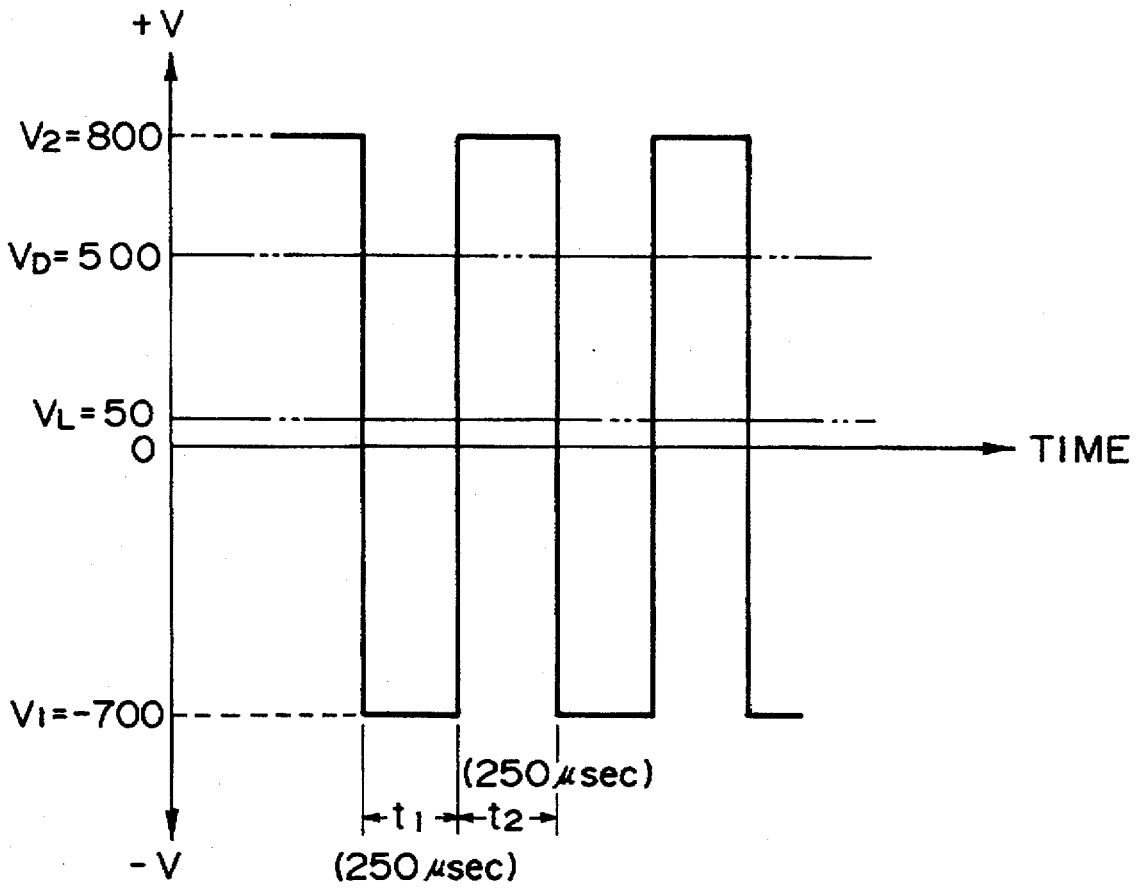
FIG. 4 illustrates an oscillating bias voltage in a conventional example.
Figure 5:
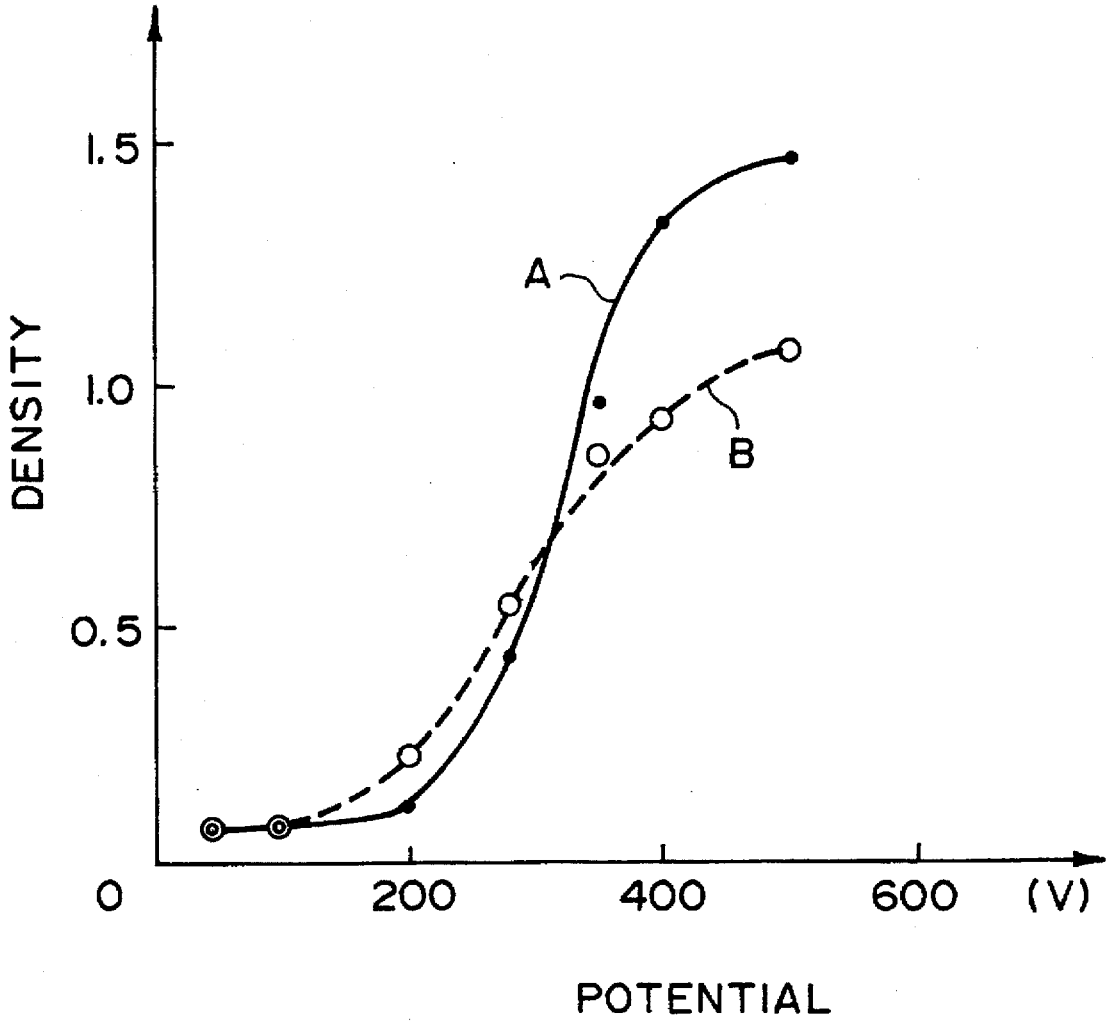
FIG. 5 shows the image densities of developed images formed with the bias voltage of FIG. 4.

FIG. 5 shows, as a comparison, the image density property provided by the oscillating bias voltage of the waveform of FIG. 4 applied to the sleeve 22, the oscillating bias voltage having a peak-to-peak voltage (Vpp) is 1500 V as in FIG. 1, and a frequency of 2 KHz as in FIG. 1 and a duty ratio of 0.5 as contrasted to FIG. 1.

In FIGS. 3 and 5, the abscissa represents the potential of the latent image, and the ordinate represent a reflection density of the developed image. In FIGS. 3 and 5, curve A represents the image density when the used toner has a weight average particle size of 15 microns; and C B represents the image density when the used toner has a weight average particle size of 8 microns (the same applies to the other drawings).

When the Figures are compared, it will be understood that in FIG. 3, both of curves A and B exhibit sufficient image density in the image portion, good tone reproducibility, good reproducibility of the low potential portion and absence of fog. It will be also understood that the density difference is small between when the used toner has the weight average particle size of 15 microns and having the charge amount of −20 micro-coulomb/g (curve A) and when the used toner has the weight average particle size of 8 microns and the charge amount of −26 micro-coulomb/g (curve B).

Referring to FIG. 5, sufficient density is provided in the image portion with the curve A, but the density of the low potential portion is not sufficient. In the curve B, the density of the low potential portion is not sufficient, and also the density of the high potential portion is low. The density difference is significant at the high potential portions between the curve A and the curve B.

As described, according to the present invention, the good developed image can be obtained even if toner having a small average particle size leading to a large charge amount per unit weight is used.

Figure 6:
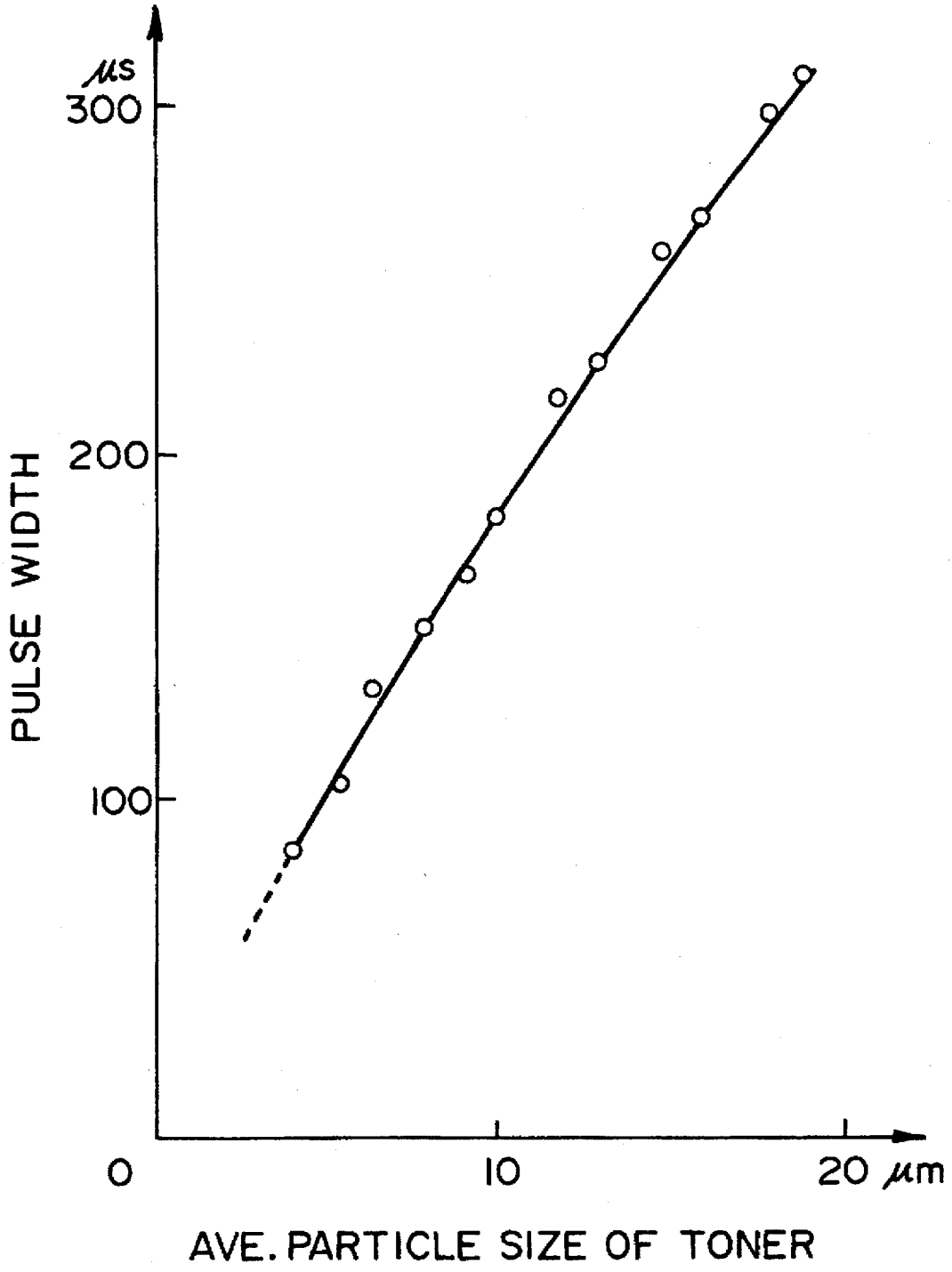
FIG. 6 shows a relation between an average particle size of the toner and a width of bias pulse.

FIG. 6 shows the relation between the weight average particle size of the toner and the developing property. The graph includes plots of the weight average particles size of the toner and the pulse width providing the maximum image density of 1.0 after the image is transferred and fixed, when the clearance between the developer carrying member and the latent image bearing member is approximately 250 microns, and the developer carrying member is supplied with the transfer voltage Vu1 (approximately 1000 V) in the form of pulses. It will be understood that the time required for the toner to reach the latent image bearing member decreases with a decrease of the particle size. The reason for this is considered as being that the amount of triboelectric charge per unit weight is higher in the small size toner.

In consideration of this, in the transfer phase of the bias voltage, the transfer electric field is made relatively stronger, and the duration thereof is made relatively shorter. By doing so, the small size toner particles having a larger amount of electric charge are transferred to develop the latent image. Subsequently, in the back-transfer phase, the back-transfer electric field is relatively weaker, and the duration thereof is made relatively longer, by which the larger toner particles or the toner particles having a smaller charge amount which have not reached the latent image bearing member during the transfer phase of the bias application because of the lower movement speed, are returned to the developer carrying member in a relatively longer period, with certainty. At this time, the fine toner particles deposited on the image portion on the latent image bearing member are hardly removed because the mirror force is strong, and the back-transfer electric field is weak. However, a smaller amount of toner particles having a smaller amount of electric charge (fog toner) deposited to the non-image portion due to scattering or the like are returned to the developer carrying member by the back-transfer electric field, because the mirror force is weak.

For the reasons described in the foregoing, the resultant images have a high image density, and the reproducibility of a thin image is good with good tone reproducibility and without foggy background. Therefore, high resolution image which is a feature of small particle size toner can be properly provided in the developed image.

It has been found that even if the amount of charge is in the range of 10 to 20 micro-coulomb/g, the toner image having the density distribution as shown by the curve A is provided, and that even if the amount of charge of the toner is in the range of 30 to 40 micro-coulomb/g, the toner image having the density distribution as shown by the curve B is provided. The same applied to the other drawings.

The ordinary amount of electric charge of the toner having a relatively large particle size is in the range of 10 to 20 micro-coulomb/g. However, even if the average particle size is relatively large, the toner contains fine toner particles having smaller particle sizes. The electric charge of such fine toner particles per unit weight tends to be larger. Particularly, under the low humidity condition or during the continuous developing operation, such fine toner particles are easily overcharged to 30 to 40 micro-coulomb/g. The over-charged fine particle toner is electrostatically attracted to the surface of the sleeve with a strong force with the result of degrading the developing performance.

Toner having an average particle size, similarly to the above-described toner particles, is easily overcharged to 30 to 40 micro-coulomb/g under a low humidity condition or during continuous developing operations.

In order to release any overcharged toner from the surface of the sleeve or the neighborhood thereof, the electric field in the transfer phase may be increased. If, however, this is simply done, the toner would be transferred to the latent image irrespective to the pattern of the latent image, with the result of increased foggy background. As described hereinbefore, the foggy background may be prevented by also increasing the bias voltage in the back-transfer phase. If, however, the bias voltage in the back-transfer phase is increased, the image portion and the low potential portion toner as well as the non-image portion toner are also removed, so that the developing performance is deteriorated to such an extent that the developed pattern is disturbed and that the tone reproducibility and the image reproducibility are degraded. In consideration, it is desired that the bias voltage in the transfer phase is made relatively low, whereas the overcharged toner particles on or adjacent the sleeve surface are forced to transfer. According to the embodiment described in the foregoing, this is possible. As shown in curves A and B of FIG. 3, the image density lowering due to the overcharge of the toner was prevented.

Furthermore, according to the embodiment of the present invention, the transfer bias electric field in the asymmetrical oscillating bias voltage is strong so that the toner on and adjacent the sleeve surface can be transferred, and therefore, toner having a large charge amount on and adjacent the sleeve surface is strongly deposited on the latent image pattern. For this reason, the toner can be strongly deposited on the low potential latent image portion by the electrostatic force of the toner having a larger amount of the electric charge, by which a line image can be properly developed with proper edge effect, and therefore, very good image can be reproduced.

In the foregoing embodiment, the clearance between the sleeve 22 and the latent image bearing member 1 ("d" is 250 microns). However, this embodiment applies to the clearance of 0.05 mm–0.5 mm with good development. This is because, as compared with the conventional developing system, the transfer side bias can be increased, so that the development is possible even if the clearance between the sleeve 22 and the latent image bearing member 1 is larger.

Figure 7:
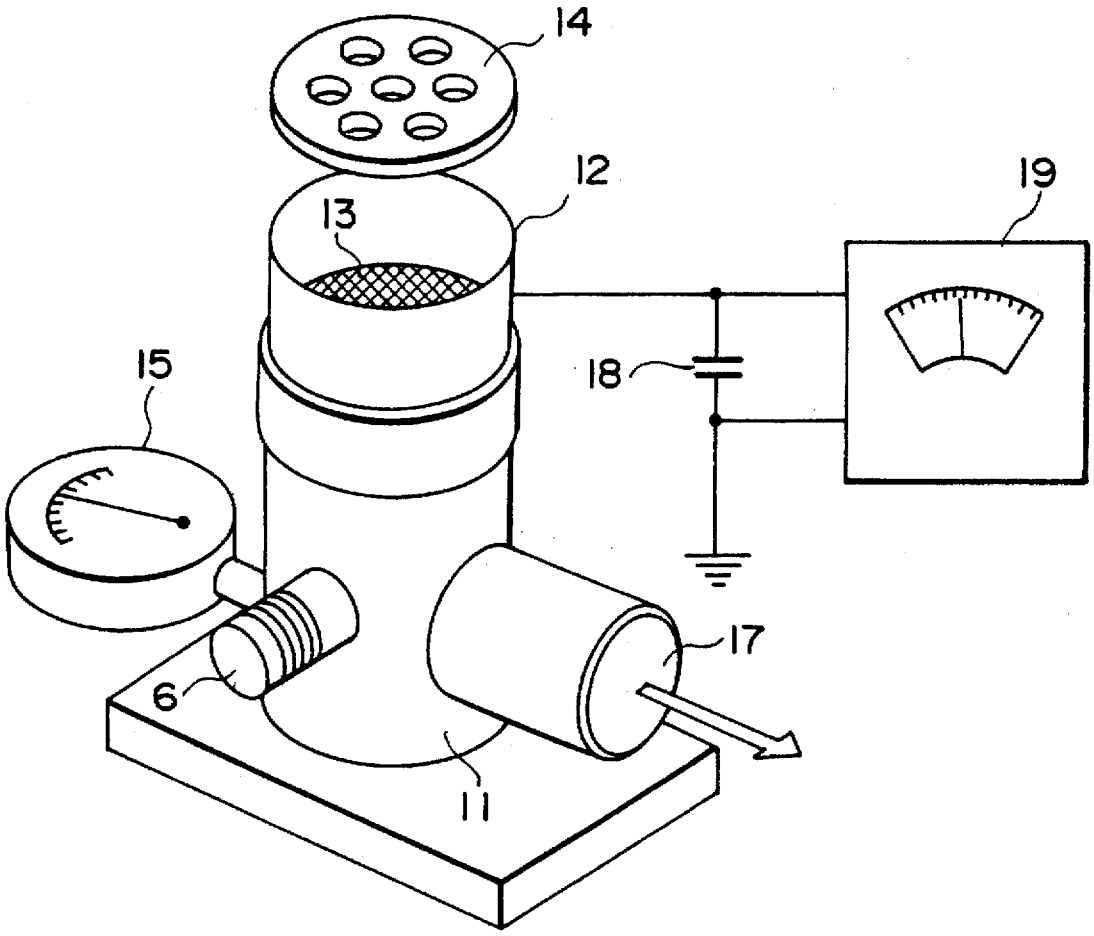
FIG. 7 illustrates a method of measuring a charging amount of toner.

Referring to FIG. 7, the measurement of the charge amount of the magnetic toner will be described. First, magnetic toner particles (1 g) to be measured and iron carrier particles of 200–300 mesh (9 g) are put into a polyester resin bin having a capacity of 50 cc. They are stirred in 20 sec. (approximately 100 times) by shaking the bin. The mixture (approximately 1 g) is put into a metal measuring container 12 having a 400 mesh screen 13 at the bottom, and is closed by a metal cap 14 having an air vent hole.

The measuring container 12 is placed on a sucking device 11 having an insulating material at the position contacted to the measuring container. The mixture is sucked through the sucking hole 17 under 250 mm $H_2O$ by the pressure gauge 15. This is continued until the potential between the capacitor 18 is saturated, for approximately 1 min. The above operations are carried out under the temperature of 23° C. and the humidity of 60%. The amount of the charge of the toner is calculated by:

Q (micro-coulomb/g)=(C×V)/M where V is the saturated voltage measured by the potentiometer 19, C is a capacitance of the capacitor, and M is weight of the toner removed by the sucking.

The weight average particle size of the toner is determined, for example, as follows.

Counter Model TA-II (available from Coulter Electronics Inc.) is used as an instrument for measurement, to which an interface (available from Nikkaki K.K.) for providing a number-average particle size distribution and a volume-average particle size distribution and a personal computer CX-1 (available from Canon K.K.) are connected.

For measurement, a 1%-NaCl aqueous solution as an electrolytic solution is prepared by using a reagent grade sodium chloride. Into 100 to 150 ml of the electrolytic solution, 0.1 to 5 ml of a surfactant, preferably an alkylbenzenesulfonic acid salt, is added as a dispersant, and 0.5 to 50 mg of a sample is added thereto. The resultant dispersion of the sample in the electrolytic liquid is subjected to a dispersion treatment for about 1–3 min. by means of an ultrasonic disperser, and then subjected to measurement of particle size distribution in the range of 2–40 microns by using the above-mentioned Coulter counter Model TA-11 with a 100 micron-aperture. From the results of the volume-basis distribution, the weight-average particle size of the sample toner are calculated.

Figure 8:
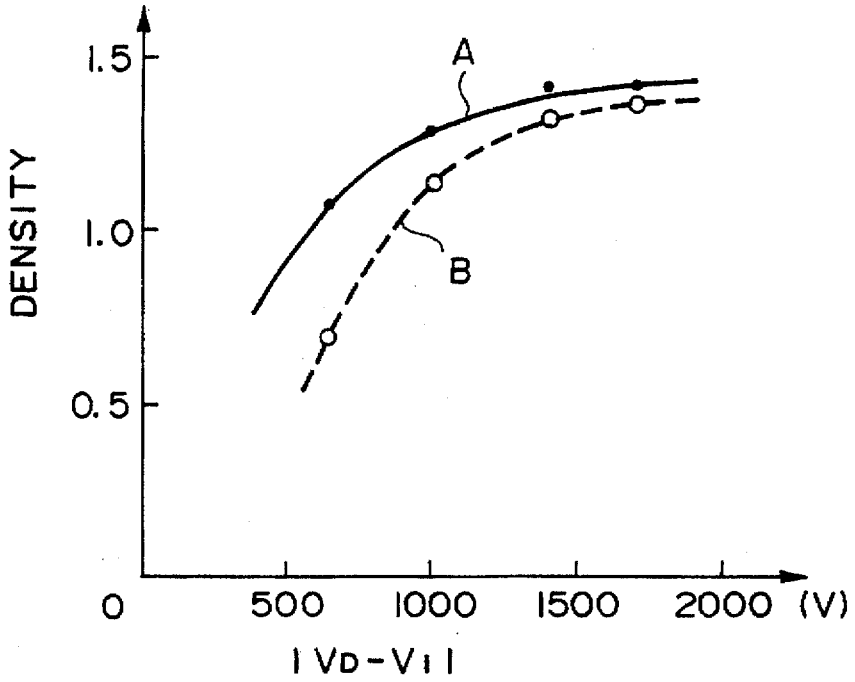
FIG. 8 shows a relation between $|V_D-V1|$ and the image density of the image portion of the developed image.

FIG. 8 shows the relationship between the potential difference $|V_D-V1|$ between the image portion potential $V_D$ of the latent image and the peak level V1 of the oscillating bias voltage in the transfer phase and the image density. In order to obtain sufficient image density when the smaller particle size toner is used or when the charge amount of the toner ranges as broad as −10 to −40 micro-coulomb/g, it is preferable that $|V_D-V1|$ is not less than 1000 V. On the other hand, if the potential difference $|V_D-V1|$ exceeds 2000 V, the electric discharge occurs between the sleeve and the photosensitive member with the result of damage to the image.

Stating correctly, the transferring power of the toner and the electric discharge is proportional to the electric field strength, and the electric field strength is the potential difference divided by the clearance d between the sleeve 22 and the drum 1. Since the clearance d is 250 microns, sufficient image density can be provided while preventing the electric discharge if 4 (V/microns)$\leqq|V_D V1|/d\leqq 8$ (V/micron).

Figure 9:
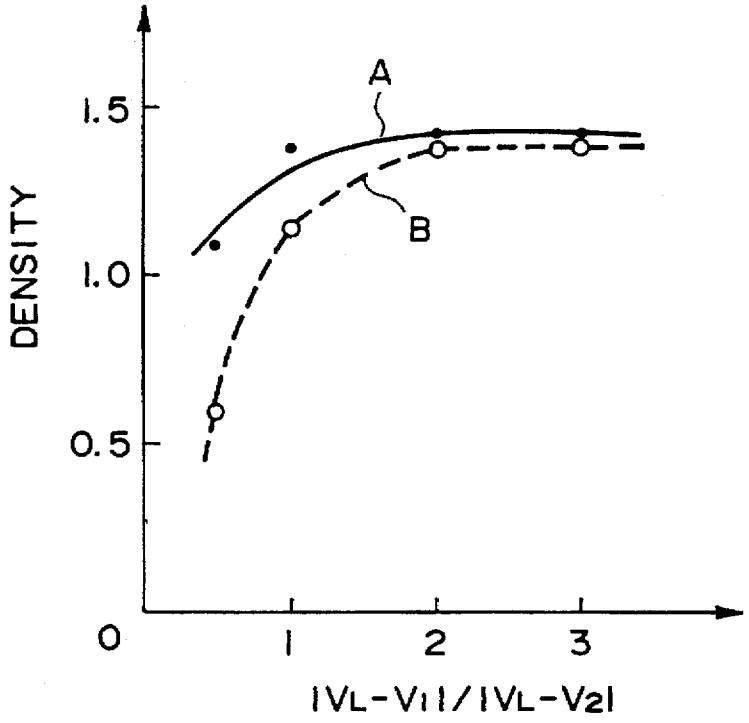
FIG. 9 shows a relation between $|V_L-V1|/|V_L-V2|$ and the image density of the image portion of the developed image.

Even if the transferring force on the toner is strong, if the back-transfer force is too strong, the toner deposited on the image portion of the drum is removed by the back-transfer voltage. As a result, sufficient image density can not be provided. FIG. 9 shows the relationship between the voltages V1 and V2 with respect to the image density. In order to sufficiently transfer the charged up toner and in order to provide sufficient image density, $|V_L-V1|\geqq|V_L-V2|$ is desirable, as will be understood.

Accordingly, it is understood that it is preferable in order to provide sufficient image density to satisfy both of 4 (V/micron)$\leqq|V_D-V1|/d\leqq 8$ (V/micron) and $|V_L-V1|\geqq|V_L-V2|$. In other words, it is preferable that the electric field strength which is the maximum potential difference between the image portion potential of the latent image and the sleeve potential divided by the clearance $\alpha$ in the transfer phase is not less than 4 (V/micron) and not more than 8 (V/micron) and that the maximum of the potential difference between the non-image portion of the latent image and the sleeve potential in the transfer phase is not less than the maximum of the potential difference between the non-image portion of the latent image and the sleeve potential in the back-transfer phase.

However, the requirement $|V_L-V1| \geqq |V_L-V2|$ easily leads to the production of a foggy background. Therefore, the relation between the foggy background production and the voltages V1 and V2 is investigated.

Figure 10:
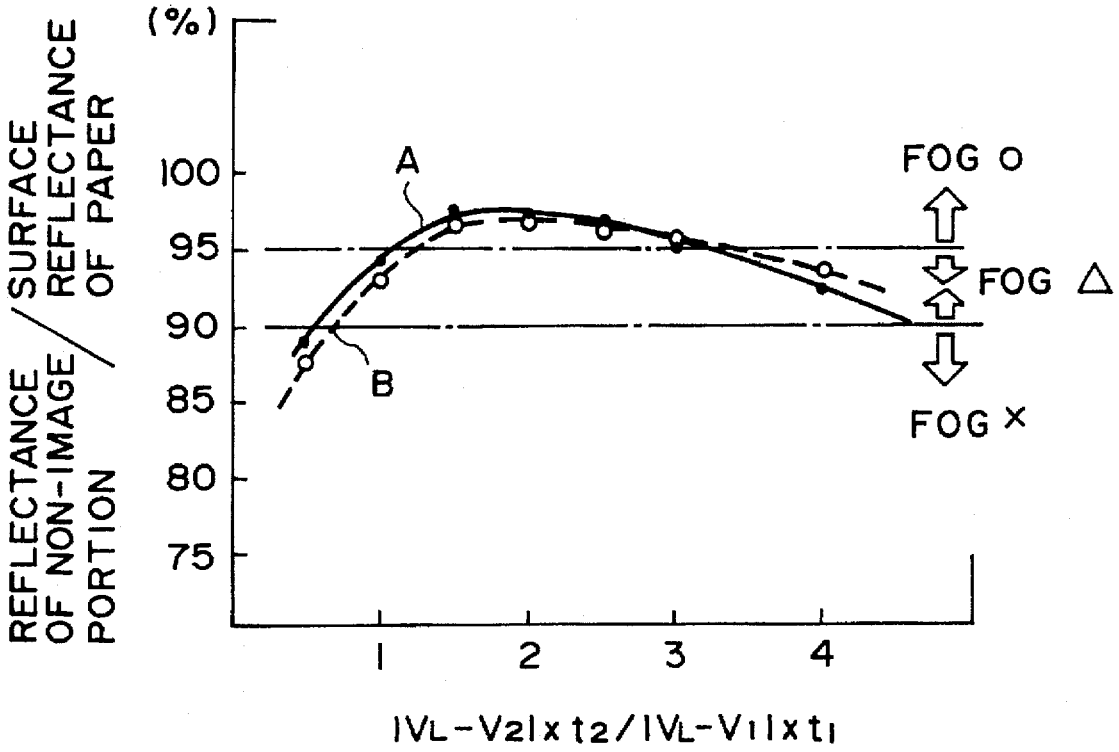
FIG. 10 illustrates the degree of fogginess.

FIG. 10 shows the results of investigations. It has been found that the foggy background production is strongly influenced by integrations, with time, of the transferring electric field strength and the back-transfer electric field strength to the light potential $V_L$ in one period of the oscillating bias voltage.

In other words, the effective value of the electric field is influential to the production of the foggy background. The coulomb force of the fog toner to the photosensitive member is much smaller than the toner deposited on the image portion, and therefore, the length of the removing duration is proportional to the amount of removal. Therefore, time integration of the back-transfer electric field strength is influential to the prevention of foggy background. On the other hand, the toner deposited on the image portion is hardly removed even if the back-transfer period is long, because the strong coulomb attracting force between the surface potential of the photosensitive member and the toner charge overcomes the removing force by the back-transfer electric field.

Figure 11:
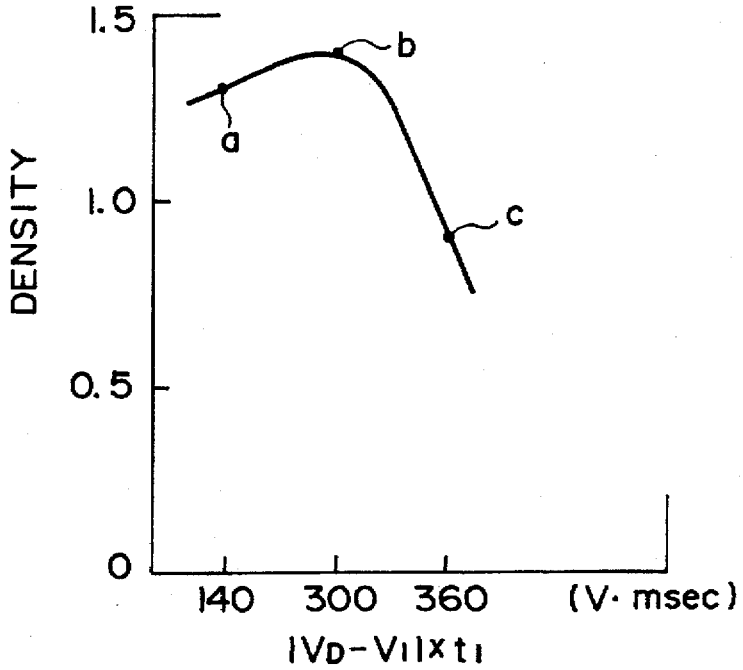
FIG. 11 shows a relation between $|V_D-V1|\times t_1$ and the image density of the image portion of the developed image.

This will be understood also from the fact that the time integration $|V_D-V1| \times t_1$ of the transfer electric field strength to the image portion does not explain the change in the image density shown in FIG. 8. FIG. 11 shows that even if $|V_D-V1| \times t_1$ is large, the image density extremely decrease with the decrease of the voltage V1. In FIG. 11, a plot a is the image density of the image portion of the toner image which is provided with an oscillating bias voltage when V1=−900 (V), $t_1$=100 msec, and the duty ratio is 0.2; a plot b is the image density of the toner image which is provided with an oscillating bias voltage when V1=−700 (V), $t_1$=250 msec, and the duty ratio is 0.5; and a plot c is the image density of the toner image which is produced with the oscillating bias voltage when V1=−400 (V), $t_1$=400 msec, and the duty ratio is 0.8. The values of $|V_D-V1| \times t_1$ are 140 (V.msec) at the plot a 300 (V.msec) at the plot b and 360 (V.msec) at the plot c. In all of the cases, the peak-to-peak voltage of the oscillating bias voltage was 1500 V.

From FIG. 10, it is understood that if $|V_L-V2| \times t_2 < |V_L-V1| \times t_1$, the developing power becomes larger than the removing power with the result of increased fog in the non-image area.

If $|V_L-V2| \times t_2 > 3 \times |V_L-V1| \times t_1$, the insufficiently charged toner and/or the toner charged to the opposite polarity from the developing polarity due to the triboelectric charging among toner particles, are deposited on the non-image portion by the back-transfer electric field, with the result of a foggy background.

Therefore, from the standpoint of preventing the foggy background, it is desirable that $|V_L-V1| \times t_1 \leqq |V_L-V2| \times t_2 \leqq 3 \times |V_L-V1| \times t_1$, are satisfied. In other words, it is desirable that the integral with time, of the potential difference between the non-image portion potential of the latent image and the sleeve potential in the back-transfer phase is not less than the integral, with time, therebetween in the transfer phase. Further preferably, the former is not more than three times the latter.

In the Specification, the image density is determined using a reflection type image density measuring instrument (RD914, MacBeth), and a solid image was measured in a range of 5 mm diameter.

FIG. 10 shows a comparison between the reflection rate (as the foggy background density) on paper in a region of 20 mm diameter with a reflection rate on the paper without toner, using a reflection density measuring instrument (model TC−6DS, available from Tokyo Denshoku Kabushiki Kaisha, Japan). If the ratio (non-image portion reflection rate)×100/(surface reflection rate of paper) (%) is not less than 95%, the fog hardly exists, that is the background fog is at a sufficiently low level (o). If it is not more than 90%, the foggy background is so strong that it is not practical (x). If it is 95–90%, the fog is at the intermediate level.

Figure 12:
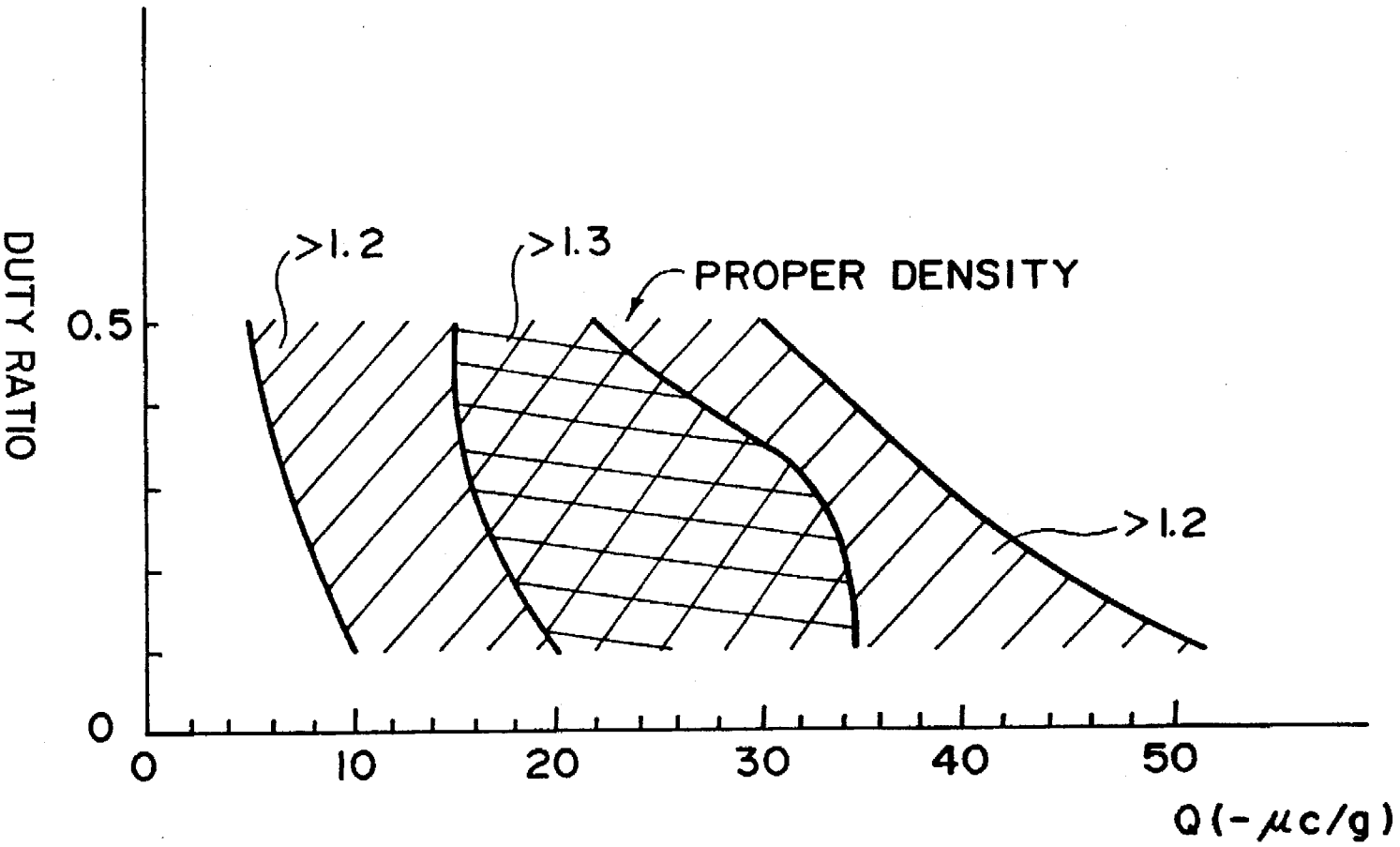
FIG. 12 shows a relation between a charging amount of the toner and the duty ratio.

FIG. 12 shows a relation among the charge amount Q (micro-coulomb/g)/unit weight of the toner, the duty ratio and the image density. In order to obtain an image having an image density not less than 1.2, it will be understood from FIG. 12, that the duty ratio D satisfies:

$$(1/D) \leqq |Q| \leqq (2.5/D)+25$$

If this is satisfied, good images can be provided even if small particle size toner resulting in a larger charge amount per unit weight (weight average particle size is 4–9 microns) is used, for example, toner having the weight average particle size of 9 microns has 25 micro-coulomb/g, and toner having the weight average particle size of 4 microns has 50 micro-coulomb/g.

Figure 13:
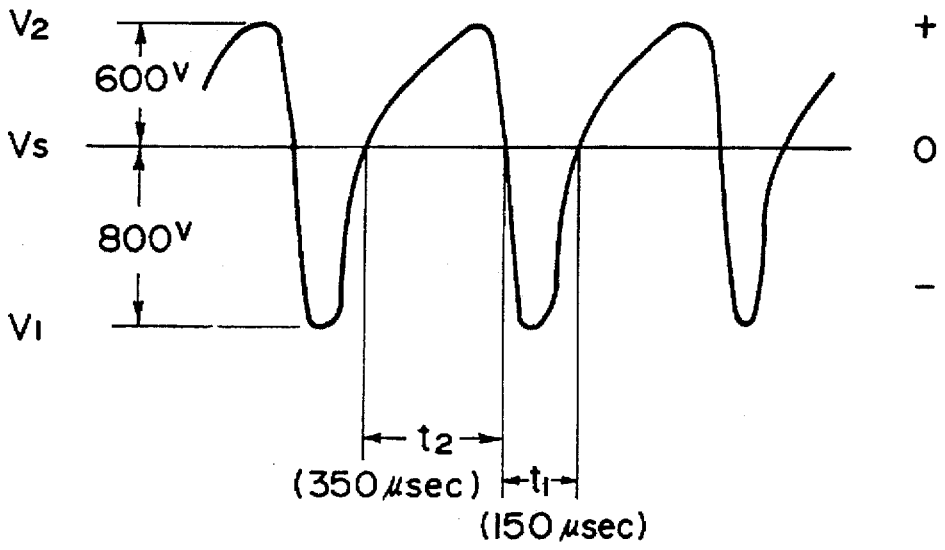
FIG. 13 illustrates a waveform of an oscillating bias voltage according to another embodiment of the present invention.
Figure 14:
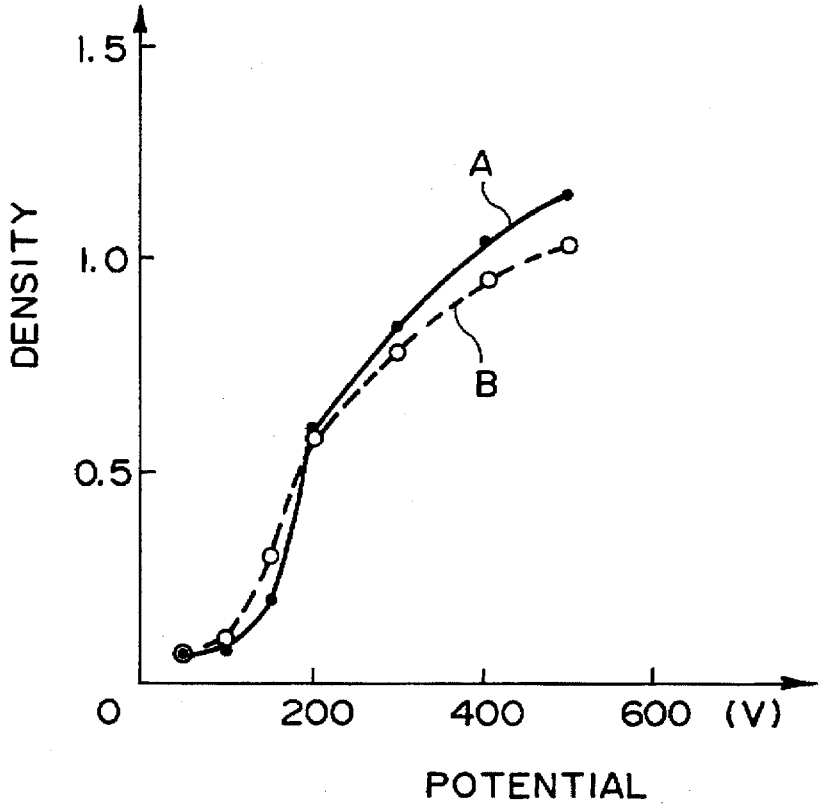
FIG. 14 illustrates the image density of the image developed with the use of the bias voltage of FIG. 13.

FIG. 13 shows an example of an oscillating bias voltage having the duty ratio of 0.3 and having a waveform similar to a sine wave. FIG. 14 shows the image density property provided when the bias voltage of FIG. 13 is applied to the sleeve 22 of FIG. 2. The dark portion potential $V_D$ of the latent image is +500 V and the light portion potential $V_L$ is +50 V. Even if the oscillating bias voltage has this waveform it is also advantageous as in the foregoing embodiments. The present invention is satisfactorily embodied with a triangular waveform or another waveform with the same advantageous effects.

In the embodiments, the oscillating bias voltage having a duty ratio which is less than 0.5 is used. The duty ratio is preferably not less than 0.1 and not more than 0.4. If the duty ratio is larger than 0.4, the reproducibility of thin lines is deteriorated, whereas if the duty ratio is smaller than 0.1, the response of the toner to the oscillating electric field slows down with the result of poor reproducibility of tone image. Further preferably, the duty ratio is not less than 0.2 and not more than 0.3.

In addition, the frequency of the oscillating bias voltage is preferably not less than 1.0 KHz and not more than 5 KHz. If the frequency is smaller than 1.0 KHz, the tone reproducibility is better, but it becomes difficult to sufficiently remove the foggy background. This is because in the low frequency region resulting in a smaller number of toner reciprocations, the toner urging force to the latent image bearing member by the transfer bias electric field is too strong in the non-image portion, and therefore, the toner is not sufficiently removed from the non-image portion even by the toner removing force of the back-transfer bias electric field.

If the frequency is larger than 5.0 KHz, the back-transfer bias electric field is applied before the toner is not sufficiently contacted to the latent image bearing member, with the result that the developing performance is remarkably degraded. In other words, the toner particles are not able to follow the high frequency electric field. Particularly, the frequency of the asymmetrical oscillating bias voltage is further preferably not less than 1.5 KHz and not more than 3 KHz.

The minimum clearance between the image bearing member and the developer carrying member in the developing zone is preferably not less than 50 microns and not more than 500 microns.

The present invention is applicable to the system wherein the electrostatic latent image of a negative polarity (the latent image formed on an organic photoconductor, for example) is developed with a toner charged to the positive polarity. In this case, the potential $V_D$ and $V_L$ are negative, V2 is negative, and V1 is positive.

The present invention is not limited to use with an electrophotographic system, but is usable with a system wherein an electrostatic latent image is formed by ion flows modulated onto a dielectric material surface, and the electrostatic latent image is developed.

In this specification, the developer is a one-component developer not containing carrier particles, and does not preclude the toner added with a small amount of fine silica particles or the like for the purpose of improving the fluidability and the charging property or the like.

While the invention has been described with reference to the structures disclosed herein, it is not confined to the details set forth and this application is intended to cover such modifications or changes as may come within the purposes of the improvements or the scope of the following claims.

What is claimed is:

1. In a regular developing method of developing a dark potential portion of an electrostatic latent image formed on an electrophotographic photosensitive image bearing member by depositing toner electrically charged to a polarity opposite to a polarity of the latent image, wherein a developer carrying member carrying a layer of toner to a developing zone is faced to the image bearing member and is supplied with an oscillating bias voltage to form an oscillating electric field in the developing zone, the improvement wherein:

a maximum of a potential difference Vu1 between the dark portion potential of the latent image and a potential of the developer carrying member in a transfer phase of the oscillating electric field, Vu1max, is larger than a maximum of a potential difference Vr1 therebetween in a back-transfer phase thereof, Vr1max;

an integration Iu1, over time, of the potential difference Vu1 is larger than an integration Ir1, over time, of the potential difference Vr1;

a maximum of a potential difference Vu2 between a light portion potential of the latent image and a potential of the developer carrying member in the transfer phase of the oscillating electric field, Vu2max, is not less than a maximum of a potential Vr2 therebetween in the back-transfer phase thereof, Vr2max; and an integration Iu2, over time, of the potential difference Vu2 is not more than an integration Ir2, over time, of the potential difference Vr2.

2. A method according to claim 1, wherein a minimum clearance d between the image bearing member and the developer carrying member satisfies:

$4\ (\text{V/micron}) \leqq \text{Vu1max}/d \leqq 8\ (\text{V/micron})$ $1 \leqq \text{Ir2}/\text{Iu2} \leqq 3$.

3. A method according to claim 1 or 2, wherein a duty ratio of the oscillating bias voltage is not less than 0.1 and not more than 0.4.

4. A method according to claim 3, wherein the image bearing member and the developer carrying member are faced to each other with a clearance therebetween which is larger than a thickness of the toner layer.

5. A method according to claim 4, wherein the dark portion potential and the light portion potential of the latent image are between two peak levels of the oscillating bias voltage.

6. A method according to claim 5, wherein the image bearing member is an electrophotographic photosensitive member having an amorphous silicon photosensitive layer.

7. A method according to claim 1, wherein:

an integration Iu2, over time, of the potential difference Vu2 is not more than an integration Ir2, over time, of the potential difference Vr2; and a duty ratio D of the oscillating bias voltage and an amount of electric charge Q (micro-coulomb/g)/unit weight of the toner, satisfy:

$(1/D) \leqq Q \leqq (2.5/D)+25$.

8. A method according to claim 7, wherein a minimum clearance d between the image bearing member and the developer carrying member satisfies:

$4\ (\text{V/micron}) \leqq \text{Vu1max}/d \leqq 8\ (\text{V/micron})$ $1 \leqq \text{Ir2}/\text{Iu2} \leqq 3$.

9. A method according to claim 7 or 8, wherein a duty ratio of the oscillating bias voltage is not less than 0.1 and not more than 0.4.

10. A method according to claim 9, wherein the image bearing member and the developer carrying member are faced to each other with a clearance therebetween which is larger than a thickness of the developer layer.

11. A method according to claim 10, wherein the dark portion potential and the light portion potential of the latent image are between two peak levels of the oscillating bias voltage.

12. A method according to claim 11, wherein the image bearing member is an electrophotographic photosensitive member having an amorphous silicon photosensitive layer.

13. A method according to claim 10, wherein the toner has a weight average particle size of 4–9 microns.

14. In a regular developing method of developing a dark potential of an electrostatic latent image formed on an electrophotographic photosensitive image bearing member by depositing a one component developer electrically charged to a polarity opposite to a polarity of the latent image, wherein a developer carrying member carrying the one component developer layer is faced to the image bearing member and is supplied with an oscillating bias voltage to form an oscillating electric field in a developing zone, and wherein the image bearing member and the developer carrying member are faced to each other with a clearance therebetween which is larger than a thickness of the developer layer, the improvement wherein:

the oscillating bias voltage has a duty ratio which is less than 0.5 and has a first peak level and a second peak level between which the dark portion potential and a light potential of the electrostatic latent image are present;

a maximum of a potential difference Vu1 between the dark portion potential of the latent image and a potential of the developer carrying member in a transfer phase of the oscillating electric field, Vu1max, is larger than a maximum of a potential difference Vr1 therebetween in a back-transfer phase thereof, Vr1max;

an integration Iu1, over time, of the potential difference Vu1 is larger than an integration Ir1, over time, of the potential difference Vr1;

a maximum of a potential difference Vu2 between the light portion potential of the latent image and a potential of the developer carrying member in the transfer phase of the oscillating electric field, Vu2max, is not less than a maximum of a potential Vr2 therebetween in the back-transfer phase thereof, Vr2max; and an integration Iu2, over time, of the potential difference Vu2 is not more than an integration Ir2, over time, of the potential difference Vr2.

15. A method according to claim 14, wherein a minimum clearance d between the image bearing member and the developer carrying member satisfies:

4 (V/micron)≦Vu1max/d≦8 (V/micron)

1 ≦Ir2/Iu2≦3.

16. A method according to claim 14 or 15, wherein a duty ratio of the oscillating bias voltage is not less than 0.1 and not more than 0.4.

17. A method according to claim 15, wherein the image hearing member is an electrophotographic photosensitive member having an amorphous silicon layer.

18. A method according to claim 14, wherein a duty ratio D and an amount of charge Q (micro-coulomb/g)/unit weight of the toner satisfy:

(1/D)≦Q≦(2.5/D)+25.

19. A method according to claim 18, wherein a minimum clearance d between the image bearing member and the developer carrying member satisfies:

4 (V/micron)≦Vu1max/d≦8 (V/micron)

1 ≦Ir2/Iu2≦3.

20. A method according to claim 18 or 19, wherein a duty ratio of the oscillating bias voltage is not less than 0.1 and not more than 0.4.

21. A method according to claim 19, wherein the toner has a weight average particle size of 4–9 microns.

22. A method according to claim 21, wherein the image bearing member is an electrophotographic photosensitive member having an amorphous silicon photosensitive layer.

23. In a regular developing method of developing a dark potential portion of an electrostatic latent image formed on an electrophotographic photosensitive image bearing member by depositing toner electrically charged to a polarity opposite to a polarity of the latent image, and wherein a developer carrying member carrying a layer of the toner is faced to the image bearing member with a clearance which is larger than a thickness of the larger of toner, and is supplied with an oscillating bias voltage, the improvement wherein:

the oscillating bias voltage has first and second peak levels between which the dark portion potential and the light portion potential of the electrostatic latent image are present;

a difference between the first peak level which is closer to the light portion potential and the dark portion potential is not less than a difference between a second peak level closer to the dark portion potential and the light portion potential; and a duty ratio D is less than 0.5, and the duty ratio D and an amount of charge Q (micro-coulomb/g)/unit weight of the toner satisfy:

(1/D)≦Q≦(2.5/D)+25.

24. A method according to claim 23, wherein the duty ratio D is not less than 0.1 and not more than 0.4.

25. A method according to claim 24, wherein the toner has a weight average particle size of 4–9.

26. An image forming method comprising the steps of:

forming an electrostatic image on an image bearing member;

developing the electrostatic image formed on the image bearing member, not bearing a toner image, with toner to form a toner image, thereby to provide a toner bearing surface on said image bearing member;

transferring the toner image from said image bearing member onto a transfer material, thereby to provide a toner non-bearing surface on said image bearing member;

wherein in said developing step, a bias voltage is applied to the developer carrying member faced to said image bearing member to form an alternating electric field of substantially rectangular form between said image bearing member and said developer carrying member; and wherein a potential difference between an image portion potential of the electrostatic image and the developer carrying member in a transfer phase is larger than a potential difference between a non-image-portion potential of the electrostatic image and the developer carrying member in a back-transfer phase, and a time period of the back-transfer phase is longer than that of the transfer phase.

27. A method according to claim 26, wherein the image portion is a high potential portion of the electrostatic image, and the non-image-portion is a low potential portion.

28. A method according to claim 26, wherein the potential difference between the image portion potential of the electrostatic image and the developer carrying member in the transfer phase of the alternating electric field is larger than that in the back-transfer phase, and the potential difference between the non-image-portion potential of the electrostatic image and the developer carrying member in the transfer phase is not less than the potential difference therebetween in the back-transfer phase.

29. A method according to claim 26, wherein 4 (V/μm)≦$V_{u1}$/d≦8 (V/μm)

is satisfied where d is a minimum gap between the image bearing member and the developer carrying member, $V_{u1}$ is a potential difference between the image portion potential of the electrostatic image and the developer carrying member in the transfer phase of the alternating electric field.

30. A method according to claim 26, wherein the part occupied by the transfer phase of the alternating electric field is not less than 0.1 and not more than 0.4.

31. A method according to claim 30, wherein the image bearing member and the developer carrying member are faced to each other with a clearance therebetween which is larger than a thickness of the toner layer.

32. A method according to claim 31, wherein the developer is a one-component developer.

33. A method according to claim 26, wherein the image bearing member is an electrophotographic photosensitive member having an amorphous silicon photosensitive layer.

34. A method according to claim 26, wherein

1/D≦|Q|≦2.5/D+25 is satisfied where D is a time period part occupied by transfer phase of the alternating electric field, and Q (μc/g) is a charge amount per unit weight of the toner.

35. A method according to claim 26, wherein the toner has a weight average particle size of 4–9 microns.

* * * * *

UNITED STATES PATENT AND TRADEMARK OFFICE

CERTIFICATE OF CORRECTION

PATENT NO. 5,677,099 
DATED October 14, 1997
INVENTOR(S) Keishi OSAWA et al.

It is certified that error appears in the above-identified patent and that said Letters Patent is hereby corrected as shown below:

Column 2:

Line 10, "the" should be deleted; and
Line 19, "is" (second occurrence) should be deleted.

Column 3:

Line 52, "the" (second occurrence) should read --a--.

Column 7:

Line 4, "the" (second occurrence) should be deleted; and
Line 51, "C" should read --curve--.

Column 9:

Line 42, "("d"" should read --"d"--; and
Line 43, "microns)." should read --microns.--.

UNITED STATES PATENT AND TRADEMARK OFFICE

CERTIFICATE OF CORRECTION

PATENT NO. :5,677,099 
DATED :October 14, 1997
INVENTOR(S) :Keishi OSAWA et al.

It is certified that error appears in the above-identified patent and that said Letters Patent is hereby corrected as shown below:

Column 11:

Line 30, "a" should read --a,--.

Column 15:

Line 10, "hearing" should read --bearing--; and
Line 37, "layer of toner" should read --toner layer--

Column 16:

Line 23, "non-image-portion" should read --nonimage portion--; and
Line 29, "non-image-portion" should read --nonimage portion--.

Signed and Sealed this

Twenty-sixth Day of May, 1998

*Attest:*

Bruce Lehman

BRUCE LEHMAN

*Attesting Officer*

*Commissioner of Patents and Trademarks*